US012129527B2

(12) United States Patent
Perrot-Simonetta et al.

(10) Patent No.: US 12,129,527 B2
(45) Date of Patent: Oct. 29, 2024

(54) PARTS WITH A BAINITIC STRUCTURE HAVING HIGH STRENGTH PROPERTIES AND MANUFACTURING PROCESS

(71) Applicant: ArcelorMittal, Luxembourg (LU)

(72) Inventors: Marie-Thérèse Perrot-Simonetta, Neufchef (FR); Bernard Resiak, Saulny (FR); Ulrich Voll, Duisburg (DE)

(73) Assignee: ArcelorMittal, Luxembourg (LU)

( * ) Notice: Subject to any disclaimer, the term of this patent is extended or adjusted under 35 U.S.C. 154(b) by 1271 days.

(21) Appl. No.: 15/560,468

(22) PCT Filed: Mar. 23, 2016

(86) PCT No.: PCT/IB2016/000343
§ 371 (c)(1),
(2) Date: Sep. 21, 2017

(87) PCT Pub. No.: WO2016/151390
PCT Pub. Date: Sep. 29, 2016

(65) Prior Publication Data

US 2018/0057909 A1 Mar. 1, 2018

(30) Foreign Application Priority Data

Mar. 23, 2015 (WO) ..... PCT/IB2015/000384

(51) Int. Cl.
*C21D 9/52* (2006.01)
*C21D 1/18* (2006.01)
(Continued)

(52) U.S. Cl.
CPC ..... *C21D 9/525* (2013.01); *C21D 1/18* (2013.01); *C21D 6/004* (2013.01); *C21D 6/005* (2013.01);
(Continued)

(58) Field of Classification Search
None
See application file for complete search history.

(56) References Cited

U.S. PATENT DOCUMENTS 5,820,706 A 10/1998 Bellus et al.
6,558,484 B1 5/2003 Onoe et al.
(Continued)

FOREIGN PATENT DOCUMENTS

CN 102747272 B * 8/2014
JP H07316720 A 12/1995
(Continued)

OTHER PUBLICATIONS

English Equivalent—Abstract of WO 02103073 A2 (Year: 2002).*
(Continued)

*Primary Examiner* — Keith Walker
*Assistant Examiner* — Catherine P Smith
(74) *Attorney, Agent, or Firm* — Davidson Kappel LLC

(57) ABSTRACT

The present invention provides a part having a composition including, with the contents being expressed in weight-percent, 0.10≤C≤0.30, 1.6≤Mn≤2.1, 0.5≤Cr≤1.7, 0.5≤Si≤1.0, 0.065≤Nb≤0.15, 0.0010≤B≤0.0050, 0.0010≤N≤0.0130, 0≤Al≤0.060, 0≤Mo≤1.00, 0≤Ni≤1.0, 0.01≤Ti≤0.07, 0≤V≤0.3, 0≤P≤0.050, 0.01≤S≤0.1, 0≤Cu≤0.5, 0≤Sn≤0.1. A balance of the composition includes iron and unavoidable impurities resulting from the production method. The microstructure includes, in surface proportions, from 100% to 70% bainite, less than 30% residual austenite, and less than 5% ferrite. A manufacturing method is also provided.

21 Claims, 2 Drawing Sheets

(51) Int. Cl.

| | |
|---|---|
| ***C21D 6/00*** | (2006.01) |
| ***C21D 8/02*** | (2006.01) |
| ***C21D 8/06*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |
| ***C22C 38/38*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C21D 6/008* (2013.01); *C21D 8/0263* (2013.01); *C21D 8/065* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/22* (2013.01); *C22C 38/26* (2013.01); *C22C 38/28* (2013.01); *C22C 38/32* (2013.01); *C22C 38/38* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/005* (2013.01)

(56) References Cited

U.S. PATENT DOCUMENTS

| | | | | |
|---|---|---|---|---|
| 6,743,311 | B2 | 6/2004 | Nishigori et al. | |
| 9,050,646 | B2 | 6/2015 | Fukushi | |
| 9,644,247 | B2 * | 5/2017 | Matsuda | C22C 38/02 |
| 9,809,874 | B2 | 11/2017 | Tanaka et al. | |
| 2007/0051434 | A1 * | 3/2007 | Resiak | C22C 38/12 148/333 |
| 2009/0107588 | A1 * | 4/2009 | Allain | C22C 38/38 148/547 |
| 2015/0203946 | A1 * | 7/2015 | Hammer | C21D 6/004 148/602 |
| 2015/0322553 | A1 * | 11/2015 | Han | C22C 38/04 148/581 |
| 2016/0130675 | A1 | 5/2016 | Muetze et al. | |

FOREIGN PATENT DOCUMENTS

| | | | | |
|---|---|---|---|---|
| JP | 2002115024 | A | 4/2002 | |
| JP | 2010242170 | A | 10/2010 | |
| JP | 2011006781 | A | 1/2011 | |
| KR | 20120121406 | A | 11/2012 | |
| KR | 20150003280 | A | 1/2015 | |
| WO | WO-02103073 | A2 * | 12/2002 | C23C 2/12 |
| WO | 2007074984 | | 7/2007 | |
| WO | 2009138586 | | 11/2009 | |
| WO | 2014163431 | | 10/2014 | |
| WO | 2014190957 | A1 | 12/2014 | |

OTHER PUBLICATIONS

English Machine Translation of CN-102747272-B (Year: 2014).*

Bhadeshia (H. K. D. H. Bhadeshia, J. W. Christian in Metallurgical Transactions A (1990)) teaches morphology of upper and lower bainite which is well-known in the art. (Year: 1990).*

Total Material (https://www.totalmateria.com/page.aspx?ID=CheckArticle&site=kts&NM=144) (Year: 2005).*

* cited by examiner

PARTS WITH A BAINITIC STRUCTURE HAVING HIGH STRENGTH PROPERTIES AND MANUFACTURING PROCESS

The present invention covers manufacturing parts with high strength properties while being machinable, obtained from steels simultaneously exhibiting good hot ductility enabling hot-forming operations to be carried out and hardenability such that it is not necessary to carry out quenching and tempering operations to obtain the declared properties.

The invention relates more specifically to parts exhibiting, regardless of the form or complexity of the of the part, mechanical strength greater than or equal to 1100 MPa, with elastic limit greater than or equal to 700 MPa, breaking elongation A greater than or equal to 12 and constriction at break Z greater than 30%.

BACKGROUND

In the context of the present invention, the term "part" means bars of all shapes, wires or complex parts obtained by hot-forming, such as, for example, rolling, or forging with or without subsequent partial or total reheating, heat- or thermochemical treatment and/or forming with or without the removal of material, or even with the addition of material such as by welding.

The term "hot-forming" means any method for hot-forming steel that modifies the initial form of a product by an operation performed at a temperature of the material such that the crystalline structure of the steel is predominantly austenitic.

The high demand for reduction of greenhouse gases, combined with increased auto safety requirements and fuel prices led motorized land vehicle manufacturers to seek materials exhibiting high mechanical strength. This makes it possible to reduce the weight of these parts while maintaining or increasing mechanical strength performance.

Traditional steel solutions for obtaining very good mechanical characteristics have long existed. They contain alloying elements in greater or lesser amounts combined with austenitization-type heat treatments at a temperature greater than AC1, followed by quenching in an oil-type, polymer-type, or even water-type fluid and generally quenching at a temperature less than Ar3. Some disadvantages associated with these steels and with the treatments necessary to obtain the required properties may be of an economic nature (cost of alloys, cost of heat treatments), of an environmental nature (energy expended for re-austenitization, dispersed by quenching, quenching bath treatment), or of a geometric nature (formation of complex parts). In this context, steels making it possible to obtain relatively high strength, immediately after hot-forming, are assuming an increasing importance. Over time, several families of steels have been proposed which provide various levels of mechanical strength, such as, for example, micro-alloyed steels with a ferritic-pearlitic structure having various carbon contents to obtain several levels of strength. These micro-allied ferritic-pearlitic steels have been widely used in recent decades and are very often used for all kinds of mechanical parts to obtain complex parts without heat treatment immediately following hot-forming. While highly effective, these steels are now reaching their limits as designers demand mechanical properties exceeding an elastic limit of 700 MPa and a mechanical strength of 1100 MPa, which often leads them to return to the aforementioned traditional solutions.

Furthermore, depending on the thickness and the shape of the parts, it can be difficult to ensure satisfactory homogeneity in properties, particularly due to heterogeneity in cooling rates which affect the microstructure.

To meet the demand for increasingly lighter vehicles, while maintaining the economic and environmental advantages of micro-allied steels having a ferritic-pearlitic matrix, it is therefore necessary to have increasingly strong steels, obtained immediately after hot-forming operations. However, in the field of carbon steel, it is known that an increase in mechanical strength is generally accompanied by a loss of ductility and a loss of machinability. Furthermore, motorized land vehicle manufacturers are specifying increasingly complex parts requiring steels exhibiting high levels of mechanical strength, fatigue strength, tenacity, formability, and machinability.

As can be seen in patent EP0787812 which describes a method for manufacturing forged parts wherein the chemical composition comprises by weight: $0.1\% \leq C \leq 0.4\%$; $1\% \leq Mn \leq 1.8\%$; $1.2\% \leq Si \leq 1.7\%$; $0\% \leq Ni \leq 1\%$; $0\% \leq Cr \leq 1.2\%$; $0\% \leq Mo \leq 0.3\%$; $0\% \leq V \leq 0.3\%$; $Cu \leq 0.35\%$, optionally 0.005% to 0.06% aluminum, optionally boron in contents comprised between 0.0005% and 0.01%, optionally between 0.005% and 0.03% titanium, optionally between 0.005% and 0.06% niobium, optionally 0.005% to 0.1% sulfur, optionally up to 0.006% calcium, optionally up to 0.03% tellurium, optionally up to 0.05% selenium, optionally up to 0.05% bismuth, optionally up to 0.1% lead, the balance being iron and impurities resulting from the production method. This method involves subjecting the part to a heat tempering treatment comprising cooling from a temperature at which the steel is completely austenitic to a temperature Tm between Ms+100 D° C. and Ms-20° C. at a cooling rate Vr greater than 0.5° C./s, followed by maintaining the part between Tm and Tf, with $Tf \geq Tm-100°$ C., and preferably $Tf \geq Tm-60°$ C., for at least 2 minutes so as to obtain a structure comprising at least 15%, and preferably, at least 30% bainite formed between Tm and Tf. This technique requires several process steps that are detrimental to productivity.

However, patent application EP1201774 is known, in which the object of the invention is to provide a forging method performed so at to improve machinability, by modifying the metallographic structure of products subjected to the impact load of a fine ferritic-pearlitic structure without adopting the quenching and tempering method, in order to obtain an elastic limit exceeding that obtained by the quenching and tempering method. The tensile strength (Rm) obtained is less than that obtained with the quenching and tempering method. This method also has the disadvantage of requiring numerous process steps which make the manufacturing method more complex. Furthermore, the absence of specified elements of chemical composition may lead to the use of a chemical composition unsuitable for applications involving forged parts due to detrimental effects of weldability, machinability or even tenacity.

SUMMARY OF THE INVENTION

An object of the present invention is to resolve the aforementioned problems. The present invention provides steel for hot-formed parts with high strength properties, simultaneously exhibiting mechanical strength and deformation capacity enabling hot-forming operations to be performed. The present invention relates more particularly to steels having a mechanical strength greater than or equal to 1100 MPa (i.e., hardness greater than or equal to 300 Hv), having an elastic limit greater than or equal to 700 MPa, and having breaking elongation greater than or equal to 12%, with a constriction at break greater than 30%. The invention also provides a steel capable of being produced in a robust manner, i.e., without great variations in properties as a function of manufacturing parameters and capable of being machined with commercially available tools without loss of productivity during implementation.

The present invention provides a part wherein the composition comprises, with the contents being expressed as weight-percent, $0.10 \leq C \leq 0.30$ $1.6 \leq Mn \leq 2.1$ $0.5 \leq Cr \leq 1.7$ $0.5 \leq Si \leq 1.0$ $0.065 \leq Nb \leq 0.15$ $0.0010 \leq B \leq 0.0050$ $0.0010 \leq N \leq 0.0130$ $0 \leq Al \leq 0.060$ $0 \leq Mo \leq 1.00$ $0 \leq Ni \leq 1.0$ $0.01 \leq Ti \leq 0.07$ $0 \leq V \leq 0.3$ $0 \leq P \leq 0.050$ $0.01 \leq S \leq 0.1$ $0 \leq Cu \leq 0.5$ $0 \leq Sn \leq 0.1$, and a balance of the composition includes iron and unavoidable impurities resulting from the production method. The microstructure comprises, in surface proportions, from 100% to 70% bainite, less than 30% of residual austenite, and less than 5% ferrite.

The present invention also provides a manufacturing method for a steel part comprising the following sequential steps:

steel of composition according to any one of claims 1 to 14 is provided in the form of a bloom, a billet having a rectangular, square, or round cross-section, or in the form of an ingot, then this steel is rolled in the form of a semi-finished product, in the form of a bar or a wire, then said semi-finished product is brought to a reheating temperature ($T_{rech}$) between 1100° C. and 1300° C. to obtain a reheated semi-finished product, then said reheated semi-finished product is hot-formed, the temperature at the end of the hot-forming being greater than or equal to 850° C. to obtain a hot-formed part, then said hot-formed part is cooled until it reaches a temperature between 620° C. and 580° C. at a cooling rate Vr600 between 0.10° C./s and 10° C./s, then said part is cooled to a temperature between 420° C. and 380° C. at a cooling rate Vr400 less than 4° C./s, then the part is cooled to a temperature between 380° C. and 300° C. at a rate less than or equal to 0.3° C./s, then the part is cooled to ambient temperature at a rate less than or equal to 4° C./s, then, optionally said hot-formed part is subjected to a heat tempering treatment and cooled to ambient temperature, at a tempering temperature between 300° C. and 450° C. for a time between 30 minutes and 120 minutes, then machining of the parts is performed.

BRIEF DESCRIPTION OF THE FIGURES

The following invention will be elucidated with reference to the following figures

DETAILED DESCRIPTION

Figure 1:
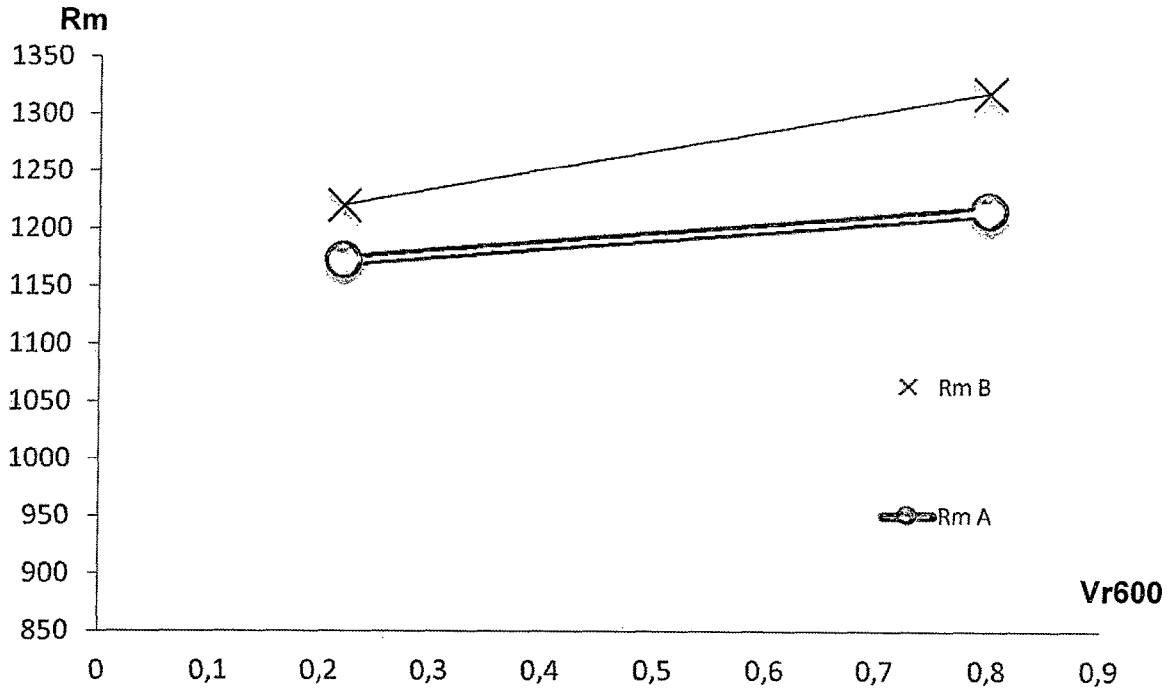
FIG. 1 shows a variation in mechanical tensile strength Rm as a function of cooling rate Vr600 for grades A and B.

Other features and advantages of the invention will appear in the course of the description hereunder, given by way of non-limiting example.

In the context of the invention, the chemical composition, in weight-percent, must be as follows:

The carbon content is between 0.10% and 0.30%. If the carbon content is below 0.10 wt-%, there is a risk of pro-eutectoid ferrite forming and the mechanical strength obtained being insufficient. Above 0.30%, weldability becomes increasingly reduced because microstructures of low tenacity may be formed in the Heat Affected Zone (HAZ) or in the molten zone. Within this range, weldability is satisfactory, and mechanical properties are stable and in accordance with the aims of the invention. According to a preferable embodiment, the carbon content is between 0.15% and 0.27% and preferably between 0.17% and 0.25%.

The manganese content is between 1.6% and 2.1% and preferably is between 1.7% and 2.0%. This is a hardening element of substitution in solid solution; it stabilizes austenite and lowers the transformation temperature Ac3. Manganese thus contributes to an increase in mechanical strength. A minimum content of 1.6 wt-% is necessary to obtain the desired mechanical properties. However, above 2.1%, its gammagenic character leads to a significant slowing in bainitic transformation kinetics occurring during the final cooling and the proportion of bainite will be insufficient to achieve yield strength greater than or equal to 700 MPa. A satisfactory mechanical strength is thereby added without increasing the risk of reducing the proportion of bainite and therefore neither decreasing the elastic limit, nor increasing hardenability in welded alloys, which is detrimental to the weldability of the steel according to the invention.

The chromium content must be between 0.5% and 1.7% and preferably between 1.0% and 1.5%. This element makes it possible to control the formation of ferrite during cooling from an initial completely austenitic structure, because ferrite, in large amounts decreases the mechanical strength required for the steel according to the invention. This element also makes it possible to harden and refine the bainitic microstructure, which explains why a minimum content of 0.5% is required. However, this element considerably slows bainitic transformation kinetics; thus, for contents greater than 1.7%, the proportion of bainite may be insufficient for achieving an elastic limit greater than or equal to 700 MPa. Preferably a range of chromium content is selected between 1.0% and 1.5% to refine the bainitic microstructure.

The silicon content must be between 0.5% and 1.0%. Within this range, the stabilization of residual austenite is made possible by the addition of silicon which considerably slows the precipitation of carbides during bainitic transformation. This was corroborated by the inventors who noted that the bainite of the invention is essentially devoid of carbides. This is because the solubility of silicon in cementite is quite low and this element increases the activity of carbon in austenite. Any formation of cementite will thus be preceded by a step wherein Si is expelled at the interface. The enrichment of austenite with carbon thus leads to its stabilization at ambient temperature in the steel according to this first embodiment. Thereafter, the application of an external stress at a temperature less than 200° C., for example, by forming or mechanical stress of the work-hardening type or the fatigue type, may result in the transformation of a portion of this austenite into martensite. This transformation will result in an increase of the elastic limit. The minimum silicon content must be set at 0.5 wt-% to obtain a stabilizing effect on austenite and to retard carbide formation. Furthermore, it is noted that, if silicon is less than 0.5%, the elastic limit is below the required minimum of 700 MPa. Moreover, an addition of silicon in an amount greater than 1.0% will result in excess residual austenite which will decrease the elastic limit. Preferably, the silicon content will be between 0.75% and 0.9% in order to optimize the aforementioned effects.

The niobium content must be between 0.065% and 0.15%. This is a micro-alloy element which forms hardening precipitates with carbon and/or nitrogen. It also makes it possible to retard bainitic transformation, in synergy with micro-alloy elements such as boron and molybdenum present in the invention. The niobium content must nevertheless be limited to 0.15% in order to avoid not only the formation of large precipitates which may be crack initiation sites but also problems related to loss of ductility at high temperatures associated with possible intergranular precipitation of nitrides. Furthermore, the niobium content must be greater than or equal to 0.065%, which, when combined with titanium, makes possible a stabilizing effect on the final mechanical properties, i.e., a decreased sensitivity to the cooling rate. Indeed, carbonitrides mixed with titanium may form and remain stable at relatively high temperatures, thus preventing the abnormal growth of grains at high temperature, or even making possible a sufficiently substantial refinement of the austenitic grain. Preferably, the maximum Nb content is in the range of 0.065% to 0.110% to optimize the abovementioned effects.

The titanium content must be such that $0.010\% < Ti < 0.1\%$. A maximum content of 0.1% is tolerated, above which titanium will increase the price and generate precipitates detrimental to fatigue resistance and machinability. A minimum content of 0.010% is necessary for controlling the size of the austenitic grain and for protecting boron from nitrogen. Preferably, a range of titanium content is selected between 0.020% and 0.03%.

The boron content must be between 10 ppm (0.0010%) and 50 ppm (0.0050%). This element makes it possible to control the formation of ferrite during cooling from an initial completely austenitic structure, because this ferrite at high levels decreases the mechanical strength and the elastic limit covered by the invention. This is a quenching element. A minimum content of 10 ppm is necessary to prevent ferrite formation during natural cooling and which is thus generally less than 2° C./s for the types of parts covered by the invention. However, above 50 ppm boron will cause the formation of iron borides which may be detrimental to ductility. Preferably a range of boron content is selected between 20 ppm and 30 ppm to optimize the aforementioned effects.

The nitrogen content must be between 10 ppm (0.0010%) and 130 ppm (0.0130%). A minimum content of 10 ppm is necessary to form the aforementioned carbonitrides. However, above 130 ppm nitrogen may cause excessive hardening of the bainitic ferrite, with possible reduced resilience of the finished part. Preferably, a range of nitrogen content is selected between 50 ppm and 120 ppm to optimize the aforementioned effects.

The aluminum content must be less than or equal to 0.050% and preferably less than or equal to 0.040%, or even less than or equal to 0.020%. Preferably, the Al content is such that $0.003\% \leq Al \leq 0.015\%$. It is a residual element for which it is desirable to limit the content. It is assumed that high aluminum levels increase erosion of refractories and cause clogging of nozzles during steel casting. In addition, aluminum segregates negatively and it can lead to macro-segregations. In excessive amounts, aluminum may decrease hot ductility and increase the risk of defects during continuous casting. Without thorough monitoring of casting conditions, micro- and macro-type segregation defects ultimately result in segregation on the forged part. This banded structure comprises alternating bainitic bands with various hardnesses which may be detrimental to the formability of the material.

The molybdenum content must be less than or equal to 1.0%, preferably less than or equal to 0.5%. Preferably, a range of molybdenum content is selected between 0.03% and 0.15%. Its presence favors the formation of bainite by synergy with boron and niobium. It thus ensures the absence of pro-eutectoid ferrite at grain boundaries. Above a level of 1.0%, it favors the appearance of martensite which is undesirable.

The nickel content must be less than or equal to 1.0%. A maximum level of 1.0% is tolerated, above which nickel will increase the price of the proposed solution, which may decrease its viability from an economic standpoint. Preferably a range of nickel content is selected between 0% and 0.55%.

The vanadium content must be less than or equal to 0.3%. A maximum content of 0.3% is tolerated, above which vanadium will increase the price of the solution and affect resilience. Preferably, in this invention, a range of vanadium content is selected between 0% and 0.2%.

The sulfur content may be at various levels depending on the machinability desired. There will always be a small amount because it is a residual element that cannot be reduced to a value of absolute zero, but it may also be added voluntarily. A lower level of S is desirable when the desired fatigue properties are very high. In general, the target is between 0.015% and 0.04%, it being understood that it is possible to add up to 0.1% to improve machinability. Alternatively, it is also possible to add, in combination with sulfur, one or more elements selected from among tellurium, selenium, lead, and bismuth in amounts less than or equal to 0.1% for each element.

The phosphorus content must be less than or equal to 0.050% and preferably less than or equal to 0.025%. This is an element which hardens in solid solution but which considerably reduces weldability and hot ductility, particularly due to its propensity to segregate at grain boundaries and its tendency to co-segregate with manganese. For these reasons, its content must be limited to 0.025% in order to obtain good weldability.

The copper content must be less than or equal to 0.5%. A maximal amount of 0.5% is tolerated, because above this level copper may decrease the ability of the product to be shaped.

The balance of the composition includes iron and unavoidable impurities resulting from the production method, such as, for example, arsenic or tin.

In preferred embodiments, chemical compositions according to the invention may also fulfill the following conditions, taken alone or in combination:

$$0.1 \leq S1 \leq 0.4$$

and $$0.3 \leq S4 \leq 1.5$$

with $$S1 = Nb + V + Mo + Ti + Al$$

$$S2 = C + N + Cr/2 + (S1)/6 + (Si + Mn - 4*S)/10 + Ni/20$$

$$S3 = S2 + \tfrac{1}{3} \times Vr600$$

$$S4 = S3 - Vr400$$

wherein the levels of elements are expressed in weight-percent and the cooling rates Vr400 and Vr600 are expressed in ° C./s. Vr400 represents the cooling rate in the temperature range between 420° C. and 380° C. Vr600 represents the cooling rate in the temperature range between 620° C. and 580° C.

As will be described in the tests described hereunder, criterion S1 is correlated with the robustness of the mechanical properties as a function of variations in cooling in general and as a function of variations in Vr600 in particular. Respecting the ranges of values for this criterion thus makes it possible to ensure a very low sensitivity of the grade to manufacturing conditions. In a preferred embodiment, $0.200 \leq S1 \leq 0.4$, which enables further improvement of the robustness.

However, criteria S2 to S4 are correlated with obtaining a predominantly bainitic structure of more than 70% for grades according to the invention, thereby enabling the attainment of the targeted mechanical properties to be ensured.

According to the invention, the microstructure of the steel may contain, in surface proportion after the final cooling:

- bainite at a level between 70% and 100%. In the context of the present invention, the term "bainite" means a bainite comprising less than 5% on the surface of carbides and wherein the inter-lath phase is austenite.
- residual austenite at a level less than or equal to 30%
- ferrite at a level less than 5%. In particular, if the ferrite level is greater than 5%, the steel according to the invention will exhibit a mechanical strength less than the 1100 MPa targeted.

Steel according to the invention may be manufactured by the method described hereunder:

- steel of the composition according to the invention is provided in the form of a bloom, a billet having a rectangular, square, or round cross-section, or in the form of an ingot, then
- this steel is rolled in the form of a semi-finished product, in the form of a bar or of a wire then
- the semi-finished product is brought to a reheating temperature ($T_{rech}$) between 1100° C. and 1300° C. to obtain a reheated semi-finished product, then
- the reheated semi-finished product is hot-formed, the temperature at the end of the hot-forming being greater than or equal to 850° C. to obtain a hot-formed part, then,
- said hot-formed part is cooled until it reaches a temperature between 620° C. and 580° C. at a cooling rate Vr600 between 0.10° C./s and 10° C./s then
- said part is cooled to a temperature between 420° C. and 380° C. at a cooling rate Vr400 less than 4° C./s, then
- the part is cooled to a temperature between 380° C. and 300° C. at a rate less than or equal to 0.3° C./s, then
- the part is cooled to ambient temperature at a rate less than or equal to 4° C./s, then,
- optionally said hot-formed part is subjected to a heat tempering treatment and cooled to ambient temperature, at a tempering temperature between 300° C. and 450° C. for a time between 30 minutes and 120 minutes, then
- machining of the parts is performed.

In a preferred embodiment, a heat tempering treatment is performed to ensure that very good properties are obtained after cooling.

To better illustrate the invention, tests were performed on the three grades.

Tests

The chemical compositions of the steels used in the tests are indicated in Table 1. The reheating temperature of these grades was 1250° C. The temperature at the end of hot-forming was 1220° C. The cooling rates Vr600 and Vr400 are indicated in Table 2. The parts were cooled from 380° C. to ambient temperature at 0.15° C./s then they were machined. The conditions for performing the tests and the results of the measurements for characterization are summarized in Table 2.

TABLE 1

| Grade | C | Si | Mn | P | S | Al | B | Cr | Cu |
|---|---|---|---|---|---|---|---|---|---|
| A | 0.183 | 0.758 | 1.756 | 0.002 | 0.031 | 0.032 | 0.0027 | 1.437 | 0.001 |
| B | 0.183 | 0.796 | 1.699 | 0.013 | 0.029 | 0.019 | 0.0028 | 1.644 | 0.001 |
| C | 0.178 | 0.764 | 1.769 | 0.005 | 0.021 | 0.007 | 0.0024 | 1.165 | 0.006 |

| Grade | Mo | N | Ni | Sn | Ti | V | Nb | S1 |
|---|---|---|---|---|---|---|---|---|
| A | 0.072 | 0.0090 | 0.027 | 0.003 | 0.030 | 0.001 | 0.110 | 0.245 |
| B | 0.070 | 0.0089 | 0.026 | 0.003 | 0.027 | 0.001 | 0.060 | 0.177 |
| C | 0.056 | 0.0059 | 0.006 | 0.003 | 0.023 | 0.001 | 0.050 | 0.137 |

TABLE 2

| Test | Grade | Vr600 (° C./s) | Vr400 (° C./s) | S2 | S3 | S4 | Micro-structure | Rm (MPa) | Re (MPa) | A % | Z % | Re/Rm | ΔRm | ΔRe |
|---|---|---|---|---|---|---|---|---|---|---|---|---|---|---|
| 1 | A | 0.80 | 0.18 | 1.192 | 1.458 | 1.278 | 100% bainite | 1215 | 916 | 15.2 | 51.1 | 0.75 | | |
| 2 | A | 0.22 | 0.10 | 1.192 | 1.265 | 1.165 | 100% bainite | 1172 | 906 | 14.9 | 46.3 | 0.77 | 43 | 10 |
| 3 | B | 0.80 | 0.18 | 1.283 | 1.549 | 1.369 | bainite + <5% martensite | 1319 | 1036 | 14.9 | 52.2 | 0.79 | | |
| 4 | B | 0.22 | 0.10 | 1.283 | 1.356 | 1.256 | bainite + <5% martensite | 1220 | 932 | 13.4 | 42.9 | 0.76 | 99 | 104 |
| 5 | C | 0.80 | 0.18 | 1.034 | 1.301 | 1.121 | 100% bainite | 1165 | 883 | 14.8 | 48.1 | 0.76 | | |
| 6 | C | 0.22 | 0.10 | 1.034 | 1.108 | 1.008 | 100% bainite | 1042 | 749 | 16.7 | 42.7 | 0.72 | 123 | 134 |

Figure 2:
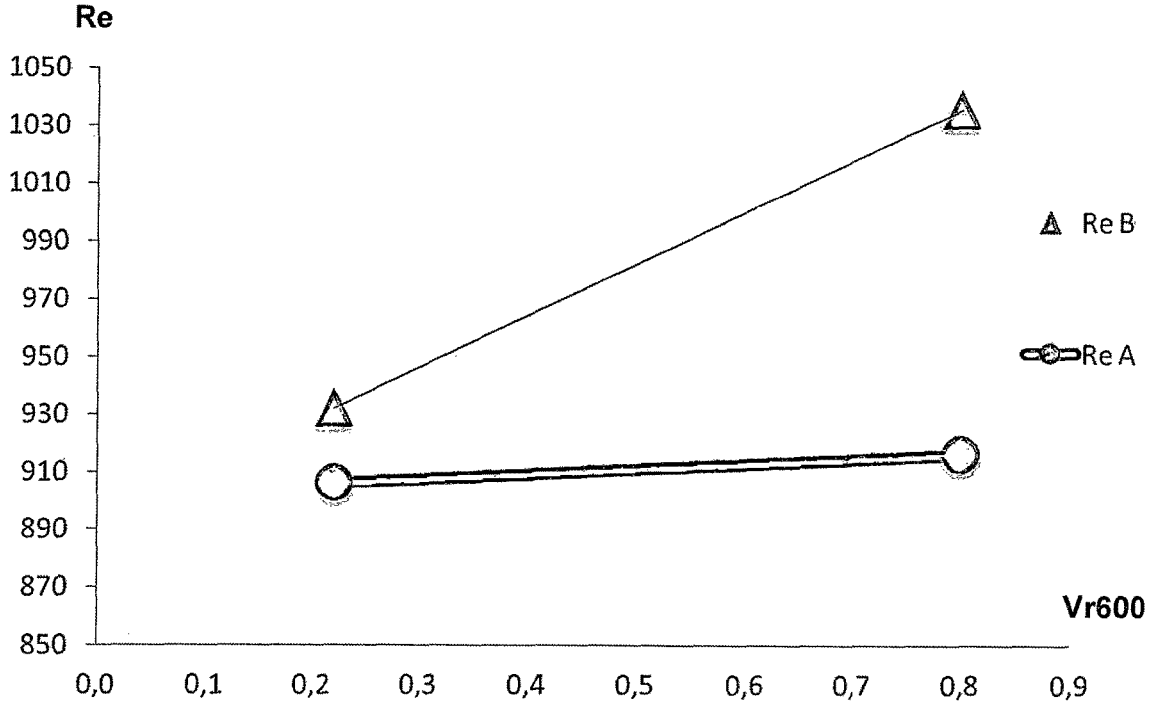
FIG. 2 shows a variation in elastic limit Re as a function of cooling rate Vr600 for grades A and B.

The results of these tests are plotted on 4 figures. FIG. 1 shows the variation in mechanical tensile strength Rm as a function of cooling rate Vr600 for grades A and B. FIG. 2 shows the variation in elastic limit Re as a function of cooling rate Vr600 for grades A and B.

It is noted that the grade according to the invention exhibits a high degree of stability of its mechanical properties as the cooling conditions vary. The grade is thus much more robust in response to variations in process conditions than grades according to the prior art.

Figure 3:
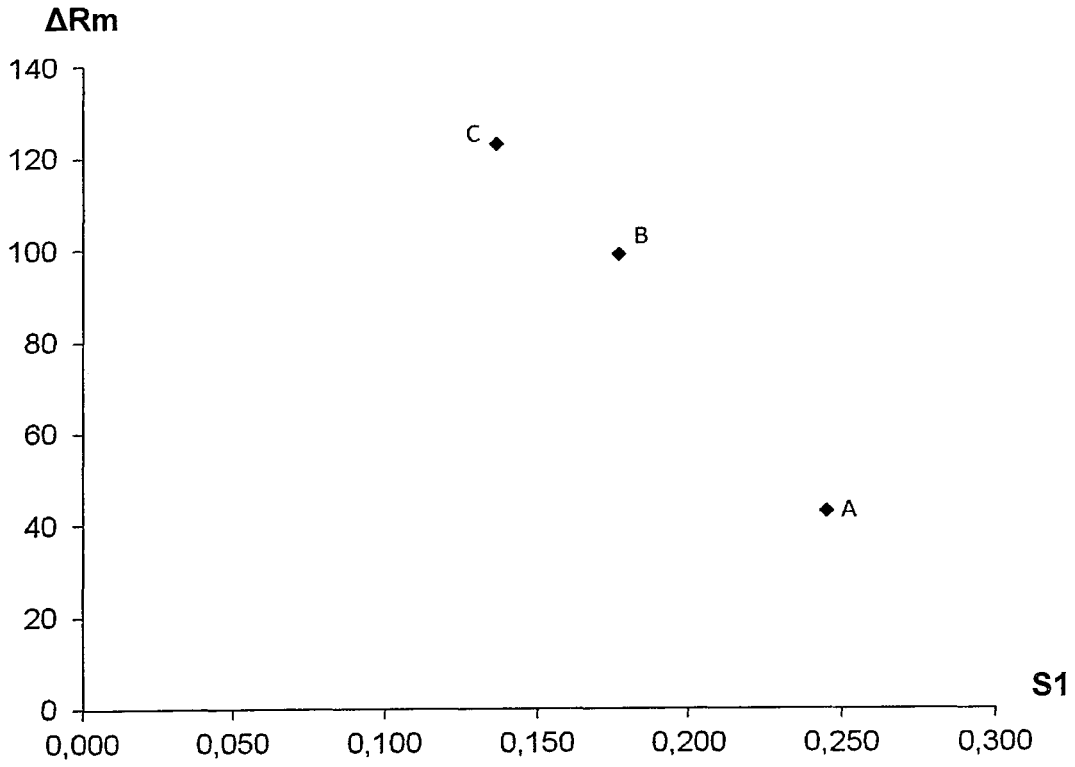
FIG. 3 shows a delta of the mechanical tensile strength Rm as a function of criterion Si for grades A, B, and C.
Figure 4:
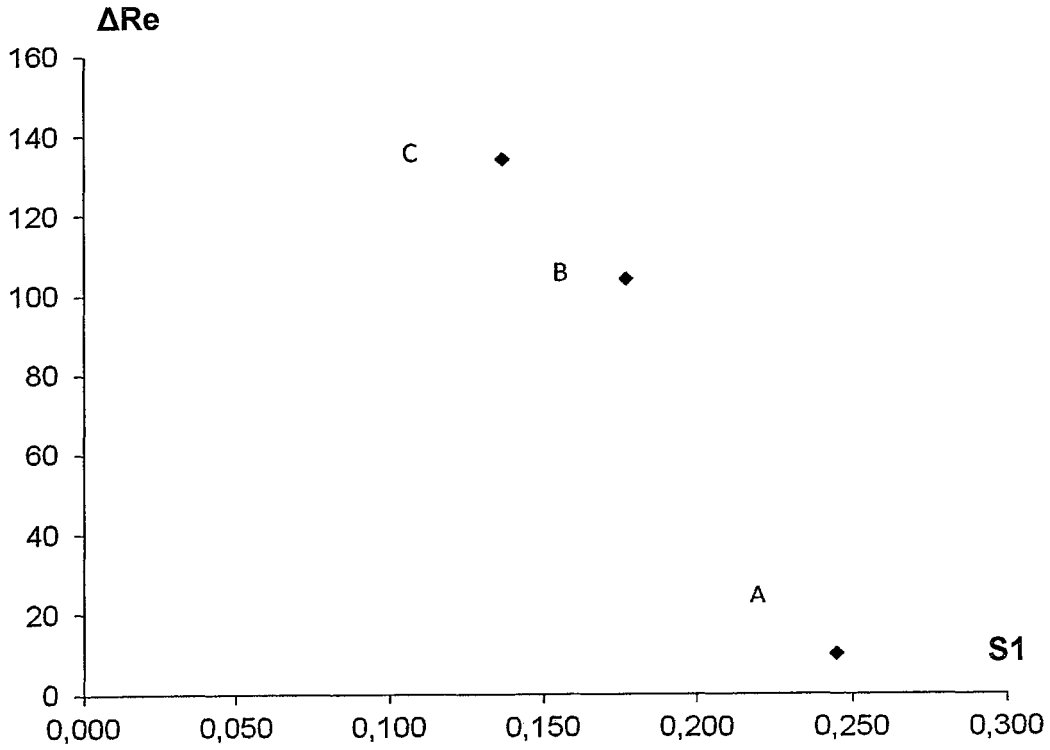
FIG. 4 shows a delta of the elastic limit Re as a function of criterion Si for grades A, B, and C.

Furthermore, FIG. 3 shows the delta of the mechanical tensile strength Rm as a function of criterion Si for grades A, B, and C. Similarly, FIG. 4 shows the delta of the elastic limit Re as a function of criterion Si for grades A, B, and C.

It is noted that the sensitivity to cooling conditions decreases as the value of Si increases.

The invention will in particular be advantageously used for manufacturing hot-formed parts, and in particular, hot-forged parts, for applications in motorized land vehicles. It also has applications in manufacturing parts for boats or in the field of construction, particularly for manufacturing screw rods for formwork.

In general, the invention may be implemented for manufacturing all types of parts that require the targeted properties to be achieved.

What is claimed is:

1. A part comprising:

a composition including, with the contents being expressed as weight-percent:

$0.10 \leq C \leq 0.30$, $1.6 \leq Mn \leq 2.1$, $0.5 \leq Cr \leq 1.7$, $0.5 \leq Si \leq 1.0$, $0.065 \leq Nb \leq 0.15$, $0.0010 \leq B \leq 0.0050$, $0.0010 \leq N \leq 0.0130$, $0 \leq Al \leq 0.060$, $0 \leq Mo \leq 1.00$, $0 \leq Ni \leq 1.0$, $0.01 \leq Ti \leq 0.07$, $0 \leq V \leq 0.3$, $0 \leq P \leq 0.050$, $0.01 \leq S \leq 0.1$, $0 \leq Cu \leq 0.5$, $0 \leq Sn \leq 0.1$; and a balance of the composition including iron and unavoidable impurities resulting from processing; and a microstructure including, in surface proportions, from 100% to 70% bainite, less than 30% of residual austenite, and less than 5% ferrite;

wherein the part exhibits a mechanical strength greater than or equal to 1100 MPa, an elastic limit greater than or equal to 700 MPa, and a breaking elongation greater than or equal to 12%, with a constriction at break greater than 30%.

2. The part according to the claim 1, wherein the contents of niobium, vanadium, molybdenum, titanium and aluminum are such that:

$0.1 \leq S1 \leq 0.4$, wherein S1=Nb+V+Mo+Ti+Al.

3. The part according to claim 2, wherein the contents of carbon, nitrogen, chromium, silicon, manganese, sulfur, and nickel are such that:

$0.5 \leq S2 \leq 1.8$, $0.7 \leq S3 \leq 1.6$, and $0.3 \leq S4 \leq 1.5$, wherein, $S2 = C + N + Cr/2 + (S1)/6 + (Si + Mn - 4*S)/10 + Ni/20$, $S3 = S2 + \frac{1}{3} \times Vr600$, and $S4 = S3 - Vr400$, and Vr400 and Vr600 being expressed in ° C./s, with Vr400 representing a cooling rate of the part in a first temperature range between 420° C. and 380° C. and Vr600 representing the cooling rate of the part in a second temperature range between 620° C. and 580° C.

4. The part according to claim 1, wherein the composition comprises, with the content being expressed in weight-percent, $0.15 \leq C \leq 0.27$.

5. The part according to claim 1, wherein the composition comprises, with the content being expressed in weight-percent, $1.7 < Mn \leq 2.0$.

6. The part according to claim 1, wherein the composition comprises, the content being expressed in weight-percent $1.0\% \leq Cr \leq 1.5$.

7. The part according to claim 1, wherein the composition comprises, the content being expressed in weight-percent, $0.75 \leq Si \leq 0.9$.

8. The part according to claim 1, wherein the composition comprises, the content being expressed in weight-percent, $0.065 \leq Nb \leq 0.110$.

9. The part according to claim 1, wherein the composition comprises, the content being expressed in weight-percent, $0.0020 \leq B \leq 0.0030$.

10. The part according to claim 1, wherein the composition comprises, the content being expressed in weight-percent, $0.0050 \leq N \leq 0.0120$.

11. The part according to claim 1, wherein the composition comprises, the content being expressed in weight-percent, $0.003 \leq Al \leq 0.015$.

12. The part according to claim 1, wherein the composition comprises, the content being expressed in weight-percent, $0 \leq Ni \leq 0.55$.

13. The part according to claim 1, wherein the composition comprises, the content being expressed in weight-percent, $0 < V \leq 0.2$.

14. The part according to claim 1, wherein the composition comprises, the content being expressed in weight-percent, $0.03 < Mo \leq 0.15$.

15. The part according to claim 1, wherein the microstructure comprises 0% ferrite.

16. The part according to claim 1, wherein the microstructure comprises ferrite.

17. The part according to claim 1, wherein the part comprises carbonitrides.

18. The part according to claim 1, wherein the composition comprises Sn.

19. The part according to claim 1, wherein the part is a bar or a wire.

20. The part according to claim 1, wherein the microstructure comprises 5% or less martensite.

21. The part according to claim 1, wherein the microstructure is free of martensite.

* * * * *